United States Patent [19]

Watanabe

[11] Patent Number: 4,534,643

[45] Date of Patent: Aug. 13, 1985

[54] IMAGE FORMING APPARATUS

[75] Inventor: Junji Watanabe, Yokohama, Japan

[73] Assignee: Tokyo Shibaura Denki Kabushiki Kaisha, Japan

[21] Appl. No.: 458,026

[22] Filed: Jan. 14, 1983

[30] Foreign Application Priority Data

Jan. 29, 1982 [JP] Japan ..... 57-12838
Jan. 29, 1982 [JP] Japan ..... 57-12849

[51] Int. Cl.[3] ..... G03G 15/00; B65H 29/60

[52] U.S. Cl. ..... 355/3 SH; 271/65; 271/186; 271/290; 271/296; 271/303; 271/4

[58] Field of Search ..... 271/4, 5, 6, 296, 288, 271/289, 290, 303, 65, 186, DIG. 9; 355/3 SH, 14 SH

[56] References Cited

U.S. PATENT DOCUMENTS 3,957,264 5/1976 Bach et al. ..... 271/296
4,170,349 10/1979 Baumann et al. ..... 271/296
4,273,326 6/1981 Snellman et al. ..... 271/296
4,285,508 8/1981 Kaneko ..... 271/297

FOREIGN PATENT DOCUMENTS 2751182 8/1978 Fed. Rep. of Germany .
2915863 1/1980 Fed. Rep. of Germany .
2905171 2/1980 Fed. Rep. of Germany .
2059396A 4/1981 United Kingdom ..... 271/289
1598605 9/1981 United Kingdom .

*Primary Examiner*—Bruce H. Stoner, Jr.
*Assistant Examiner*—John A. Carroll
*Attorney, Agent, or Firm*—Cushman, Darby & Cushman

[57] ABSTRACT

In an electronic copying apparatus, a bin selecting carriage is movably arranged along a paper sheet convey path which communicates with a sort paper sheet convey path. The paper sheet fed to the paper sheet convey path by the bin selecting carriage is fed to one of the sort bins. As the bin selecting carriage moves, a guide selector which is arranged at the branch between a non-sort paper sheet convey path and the sort paper sheet convey path is operated. A drive mechanism for driving the guide selector for selectively feeding the paper sheets discharged from a paper discharge section to the sort and non-sort paper sheet guide paths is not required. The operation timing of the guide selector may be synchronized with the feed operation timing of the paper sheets into the respective bins of the sort storage section.

21 Claims, 20 Drawing Figures

IMAGE FORMING APPARATUS

BACKGROUND OF THE INVENTION

The present invention relates to an image forming apparatus with a sorter and, more particularly, to an image forming apparatus with a sorter which selectively stores in a plurality of bins copied papers sequentially produced by the apparatus.

As shown in FIG. 1, a conventional sorter 10 has a sorting section 14 in which paper sheets P are classified and stored in a plurality of vertically arranged sort bins 12. Above the sorting section 14 is arranged a non-sorting section 18 which has a non-sort bin 16 for storing the paper sheets P which are not sorted. A sort paper sheet guide path 20 extends horizontally in the sorter 10 to guide the paper sheet P discharged from a paper sheet discharge section toward the sorting section 14. A non-sort paper sheet guide section 22 extends vertically in the sorter 10 to guide the paper sheet P discharged from the paper sheet discharge section to the non-sorting section 18. A guide selector 24 is arranged at the branch portion of these guide paths 20 and 22. The selector 24 is driven by a driving mechanism 26 to select one of the guide paths 20 and 22 so as to guide the paper sheet P to one of the sections 14 and 18. The sort paper sheet guide path 20 is connected to a paper sheet convey path 28 which serves to guide the paper sheet P first horizontally and then vertically. The paper sheet P which is selected to be guided along the sort paper sheet guide path 20 by the guide selector 24. Pawls 30 are arranged in the vertical convey portion of the paper sheet convey path 28 to face the inlet ports of the respective bins 12. The pawls 30 are selectively driven to sort the paper sheet P guided on the vertical convey portion of the paper sheet convey path 28 into a predetermined bin 12.

The conventional sorter as described above requires the driving mechanism 26 for driving the guide selector 24 to select one of the guide paths 20 and 22, resulting in high manufacturing cost of the sorter. Furthermore, the operation timing of the guide selector 24 and of the pawls 30 for sorting the paper sheets P into the respective bins 12 must be synchronized. Error in such synchronization will give rise to sorting errors. A drive mechanism for separately driving a plurality of pawls 30 must be incorporated, which makes the structure of the sorter complex.

SUMMARY OF THE INVENTION

The present invention has been made in consideration of these circumstances and has for its object to provide an inexpensive and reliable image forming apparatus with a sorter, which does not require an exclusive driving means for driving a guide selector for selecting a sort paper sheet guide path or a non-sort paper sheet guide path to guide a paper sheet discharged from a paper sheet discharge section along the selected path, and which can automatically achieve synchronization between the operation timing of the guide selector and the sorting operations of respective bins of a sorting section.

DETAILED DESCRIPTION OF THE PREFERRED EMBODIMENTS

One embodiment of an image forming apparatus according to the present invention will now be described in detail with reference to FIGS. 2 to 17 of the accompanying drawings.

Figure 1:
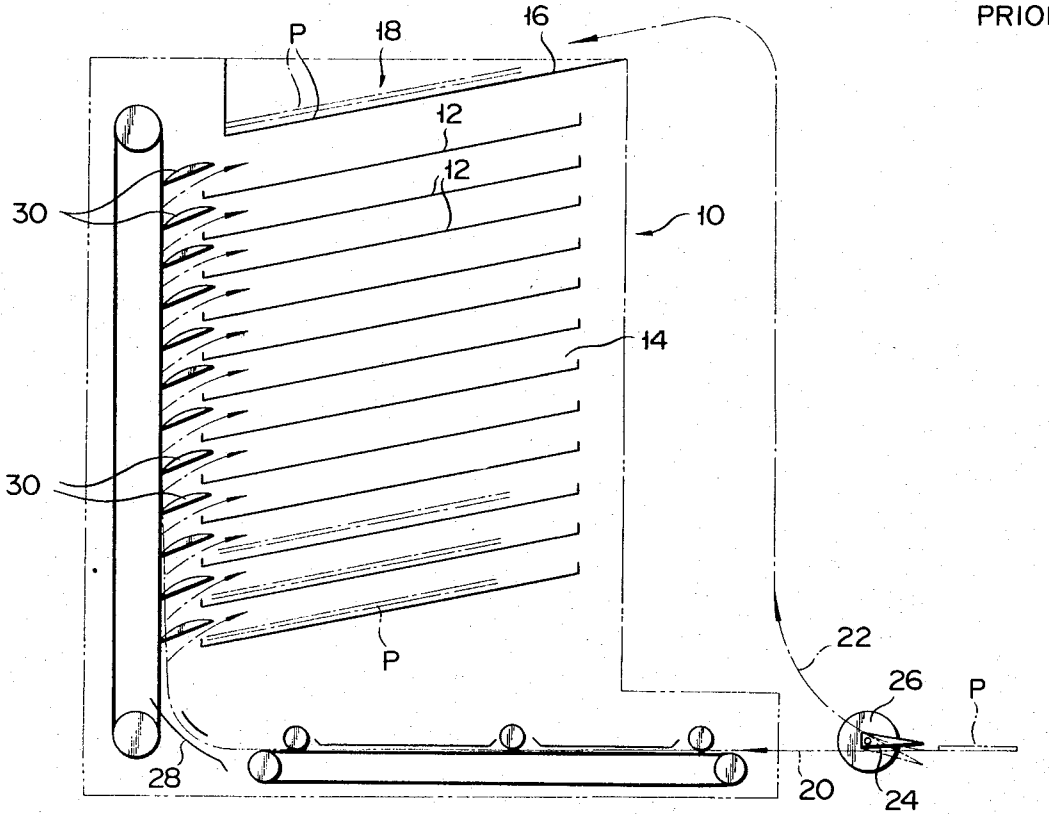
FIG. 1 PRIOR ART
FIG. 1 is a front view schematically showing a conventional sorter.
Figure 2:
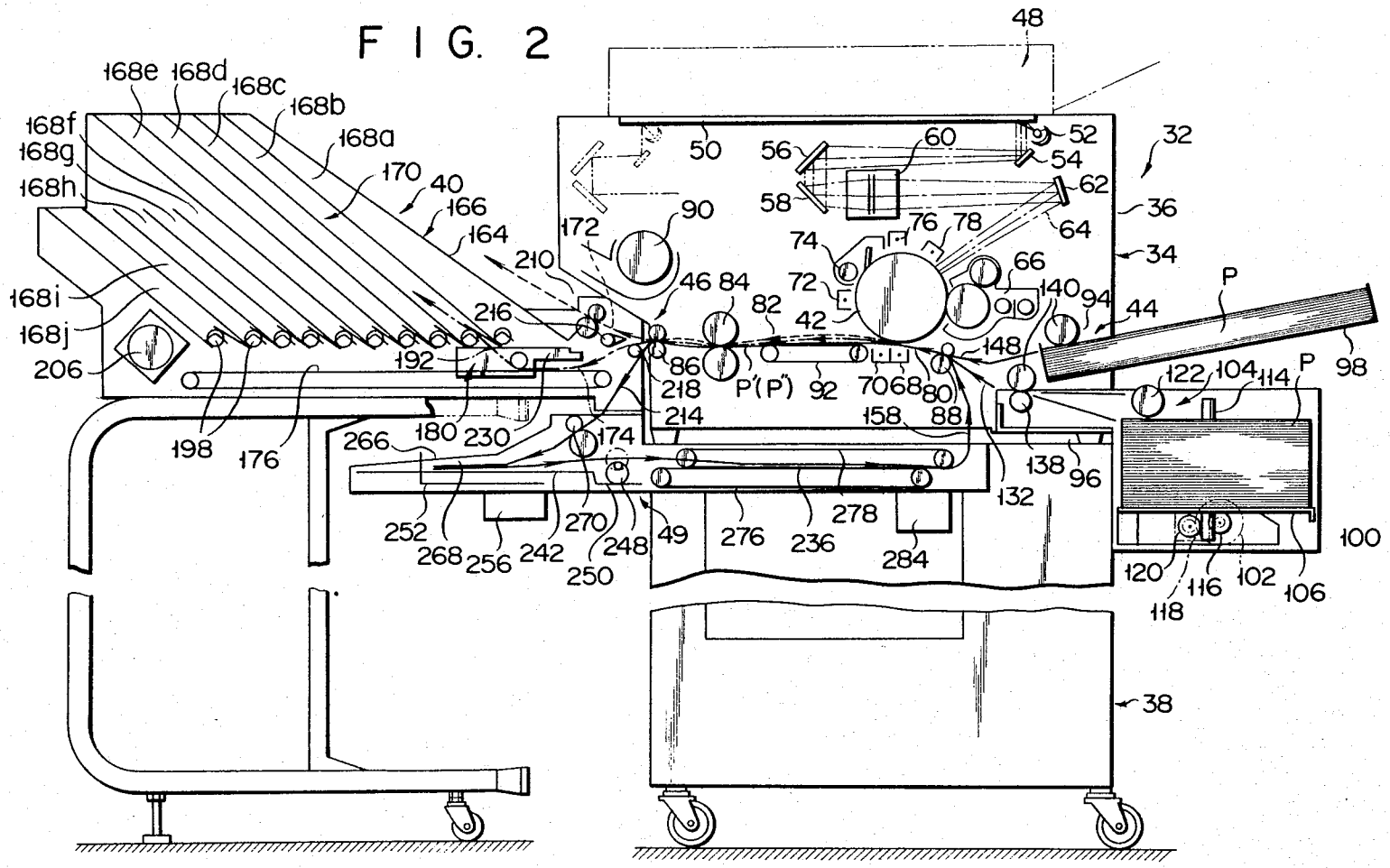
FIG. 2 is a front view schematically showing one embodiment of an electronic copying apparatus according to the present invention.

FIG. 2 schematically shows an image forming apparatus, for example, an electronic copying apparatus 32, according to one embodiment of the present invention. The electronic copying apparatus 32 has a double-side copying machine 34, a base 38 for placing a main body 36 of the copying machine 34 thereon, and a sorter 40 for selectively storing into a plurality of bins paper sheets P′ or P″, on one or both surfaces of which respectively an image or images is or are formed, and which are discharged from the copying machine 34.

The copying machine 34 has an image forming mechanism for forming an image corresponding to an image on a document onto the surface of a photosensitive drum 42 as an image carrier within the main body 36. A paper feed section 44 is arranged at one side of the main body 36, while a paper discharge section 46 is arranged at the other side thereof. An automatic document feeder (ADF) 48 is placed on the main body 36, while a double-side image copying feed/convey unit 49 for feeding the paper sheet P' to the image transfer unit a second time is arranged below the main body 36.

Figure 3:
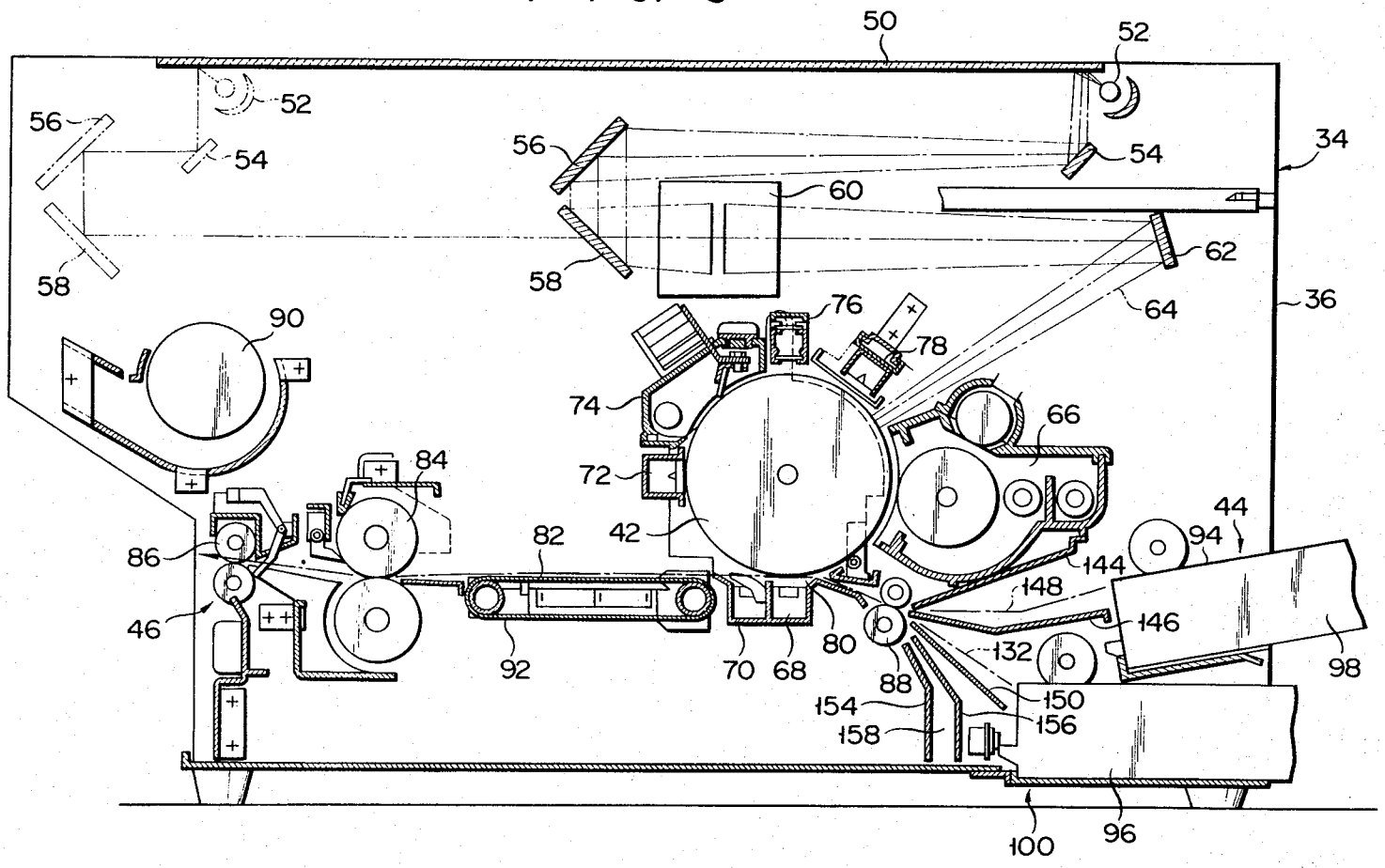
FIG. 3 is a front sectional view showing a copying machine of the electronic copying apparatus shown in FIG. 2.

As shown in detail in FIG. 3, a document table (transparent glass table) 50 for placing a document (not shown) thereon which is supplied from the ADF 48 (of known configuration) is arranged at the top of the main body 36. Below the document table 50 is arranged an optical exposure system which includes an exposure lamp 52, mirrors 54, 56 and 58, a lens 60 and a mirror 62. An exposure unit 64 scans the document surface to form an image (slit exposure) on the surface of the photosensitive drum 42. The photosensitive drum 42 rotates clockwise. Around the photosensitive drum 42 are arranged in the order named from the image forming position, along the rotating direction of the photosensitive drum 42, a developing unit 66, a transfer unit 68, a separation unit 70, a charge removal unit 72, a cleaning unit 74, a residual image erasing unit 76, and a charging unit 78, which constitute an image forming mechanism.

The image forming mechanism including the units as mentioned above performs the respective steps of residual image erasure, charging, exposure and developing so as to form a toner image on the surface of the photosensitive drum 42 corresponding to the image on the document. A paper sheet convey path 82 for conveying the paper sheet P supplied from the paper feed section 44 at one side of the main body 36 extends from an image transfer section 80 which lies between the photosensitive drum 42 and the transfer unit 68 arranged substantially immediately therebelow toward the paper discharge section 46. In synchronism with the formation of the toner image on the photosensitive drum 42, the paper sheet P (or P') is supplied to the image transfer section 80. In the image transfer section 80, the toner image formed on the photosensitive drum 42 is transferred onto the paper sheet P (or P') by the transfer unit 68. The paper sheet P' (or P'') to which the toner image or images has or have been transferred is separated from the photosensitive drum 42 by the separation unit 70 and a separation tape (not shown), and is conveyed on a paper sheet convey path 82. A pair of fixing rollers 84 as the fixing unit are arranged in the vicinity of the terminal end of the paper sheet convey path 82. The toner image on the paper sheet P' (or P'') is fixed thereon by these fixing rollers 84. A pair of paper discharge rollers 86 are arranged at the extreme terminal end of the paper sheet convey path 82 so as to discharge the paper sheet P' (or P'') with the fixed image or images thereon. The surface of the photosensitive drum 42 from which the toner image has been transferred is sequentially opposed to the charge removal unit 72, the cleaning unit 74 and the residual image erasing unit 76, and is cleaned thereby. The paper sheet convey path 82 is formed to extend substantially horizontal. A pair of register rollers 88 are arranged between the paper feed section 44 at the start end of the path 82 and the image transfer section 80. The register rollers 88 achieve a suitable timing for the feeding of paper to the image transfer section 80.

The main body 36 further has therein a blower 90 for preventing temperature rise and a suction convey unit 92 which forms the intermediate portion of the path 82.

Figure 4:
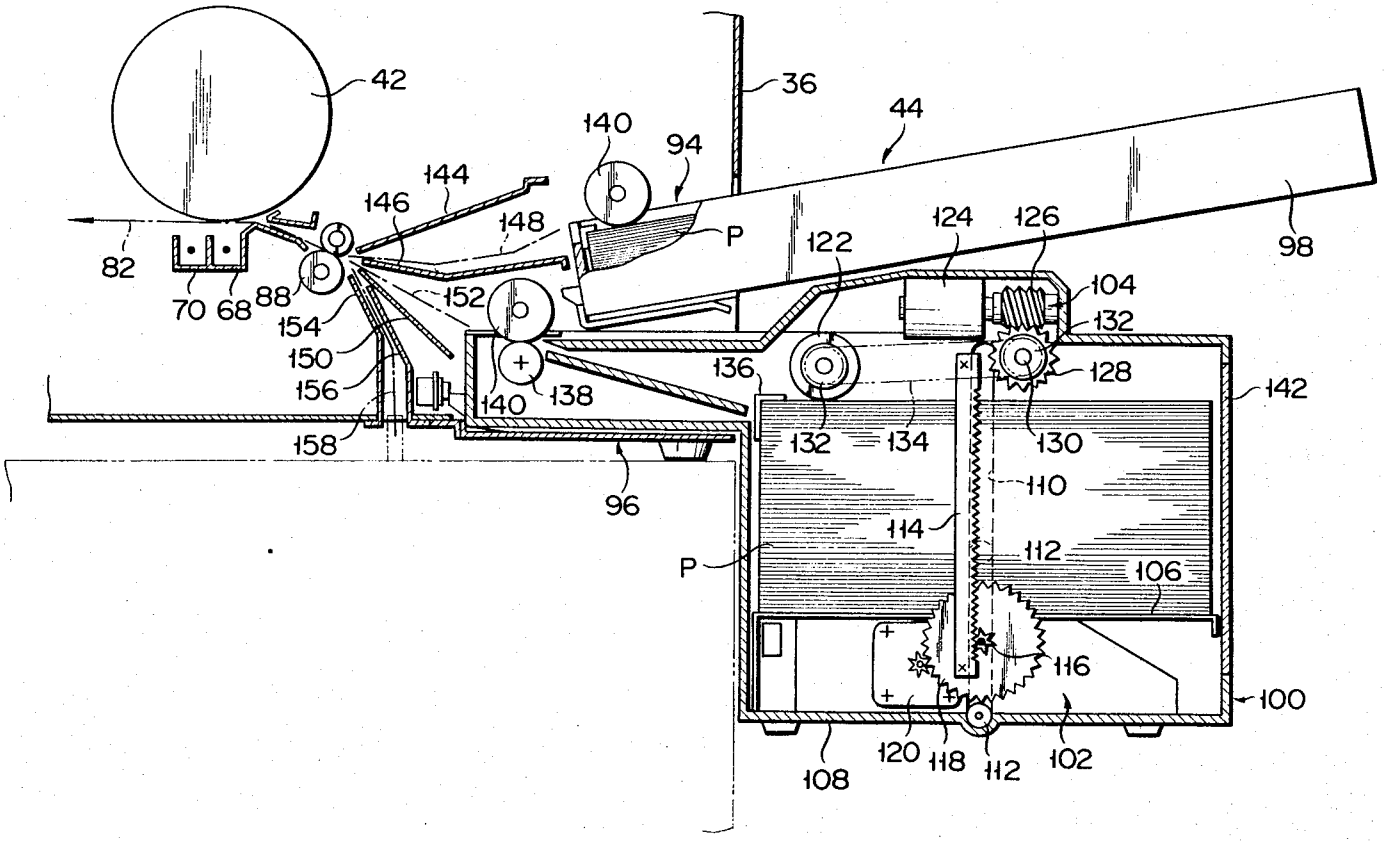
FIG. 4 is an enlarged front sectional view showing the paper feed section shown in FIG. 2.

As shown in detail in FIG. 4, the paper feed unit 44 has an upper cassette mounting section 94, and a lower cassette mounting section 96. A paper cassette 98 is detachably mounted at the upper cassette mounting section 94, while one of a paper cassette (not shown) and a feeder 100 is selectively and detachably mounted at the lower cassette mounting section 96.

The feeder 100 serves to continuously feed a large number of paper sheets P. The feeder 100 includes, for this purpose, a lift mechanism 102 for raising and lowering the stacked paper sheets P, and a pickup mechanism 104 for individually feeding the uppermost paper sheet P into the main body 36.

The lift mechanism 102 has a paper sheet table 106 for stacking a number of paper sheets P thereon. The paper sheet table 106 is rendered vertically movable by engagement between a pair of guide rollers 112 and guide grooves 110 formed on the side walls of a casing 108 of the feeder 100. Pinions 116 meshing with a pair of racks 114 respectively mounted on the side walls of the casing 108 are mounted on the sides of the paper sheet table 106. The pinions 116 are driven by a pulse motor or a DC motor 120 mounted on the paper sheet table 106 through a reduction gear mechanism 118. The paper sheet table 106 is lifted or lowered by rotating the pulse motor 120 in the forward or reverse direction.

The contact member of an upper end sensor (not shown) is in contact with the uppermost paper sheet P placed on the paper sheet table 106. The upper end sensor senses when the uppermost paper sheet P is at a certain low level after several paper sheets P have been fed out by pickup rollers 122. In response to the sensing result from the upper end sensor, a control circuit (not shown) drives the pulse motor 120 in the direction to lift the paper sheet table 106 to a certain level. In this manner, the pickup position of the paper sheets P is kept substantially constant.

As described above, the pickup mechanism 104 has the pickup rollers 122 which sequentially pick up individual paper sheets P. The pickup rollers 122 are mounted on the free ends of pivotal arms (not shown). The respective arms are constantly biased by their own weight or by weak springs, so that the pickup rollers 122 may be urged against the uppermost paper sheet P with a predetermined pressure. The pickup rollers 122 are driven at a predetermined speed by the power of a shaft 130 driven through the gear reduction mechanism 118 having a worm 126 driven by a motor 124 and a worm gear 128 meshing therewith, power being transmitted to the pickup rollers 122 through a power transmission system having a pair of pulleys 132 and a power transmission belt 134. The uppermost paper sheet P is separated by a pair of separation pawls 136 and is fed out toward the main body 36. The paper sheet P is then supplied to the paper sheet convey path 82 formed inside the main body 36 through a gap between feed rollers 138 mounted on the feeder 100 and catch rollers 140 mounted on the main body 36.

A paper sheet inlet/outlet port is formed at the front end of the casing 108 of the feeder 100. The paper sheet inlet/outlet port is opened/closed by a semitransparent cover 142 pivotally supported to be opened transversely such that the stacked state of the paper sheets P may be confirmed from the outside through this paper sheet inlet/outlet port.

In the paper feed section 44 are formed a first paper sheet guide path 148 defined by the opposing surfaces of first and second guide plates 144 and 146, a second paper sheet guide path 152 defined by the opposing surfaces of the second guide plate 146 and a third guide plate 150, and a third paper sheet guide path 158 defined by the opposing surfaces of fourth and fifth guide plates 154 and 156.

The paper sheet P picked up from the paper cassette 98 of the upper cassette mounting section 94 is guided to the register rollers 88 arranged at the start end of the paper sheet convey path 82 through the first paper sheet guide path 148. The paper sheet P picked up from the feeder 100 (or the paper cassette) of the lower cassette mounting section 96 is fed to the register rollers 88 through the second paper sheet guide path 152. The paper sheet P', on one surface of which an image is already formed, conveyed from the double-side image forming feed/convey unit 49 is guided to the register rollers 88 through the third paper sheet guide path 158.

The sorter 40 for sorting the paper sheets P' or P'' discharged from the copying machine 34 is placed on a movable base 160. The sorter 40 is easily detachable from the paper discharge section 46 of the copying machine 34.

Figure 5:
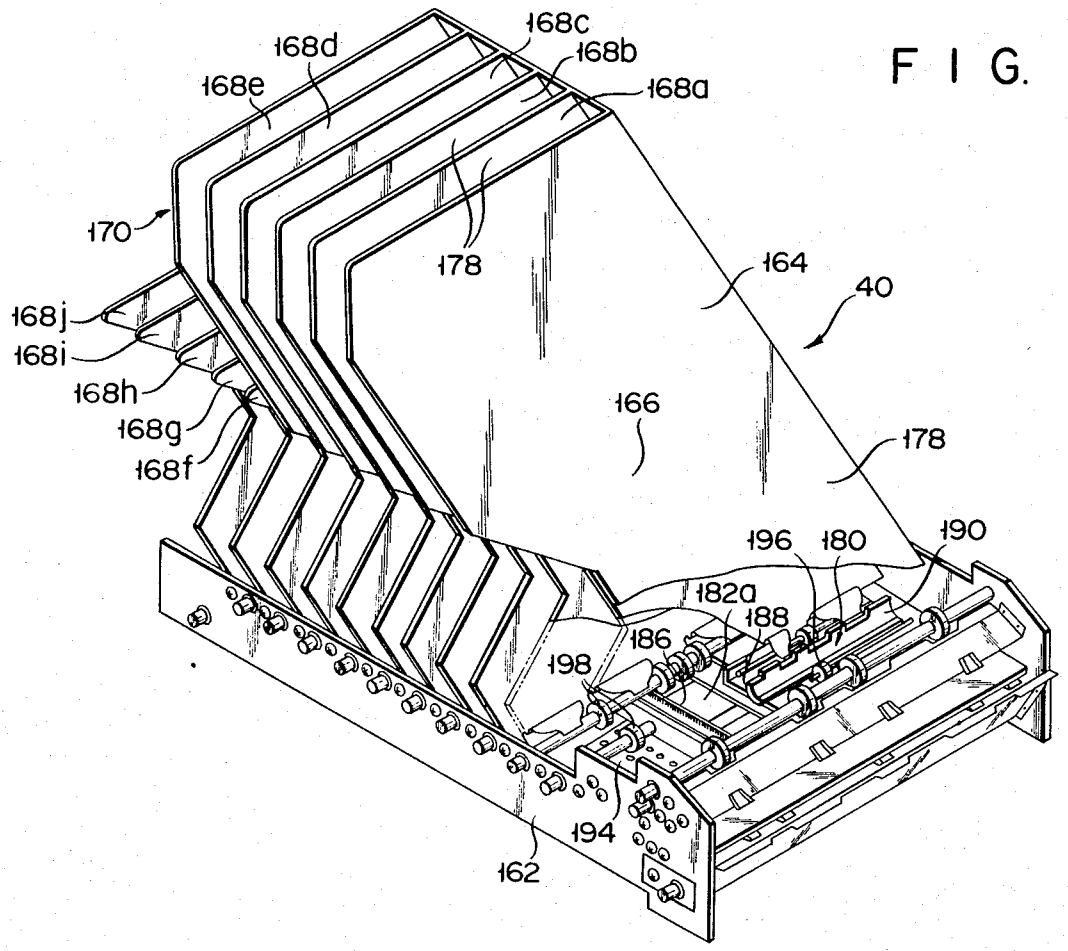
FIG. 5 is a partially cutaway perspective view of the sorter shown in FIG. 2.
Figure 6:
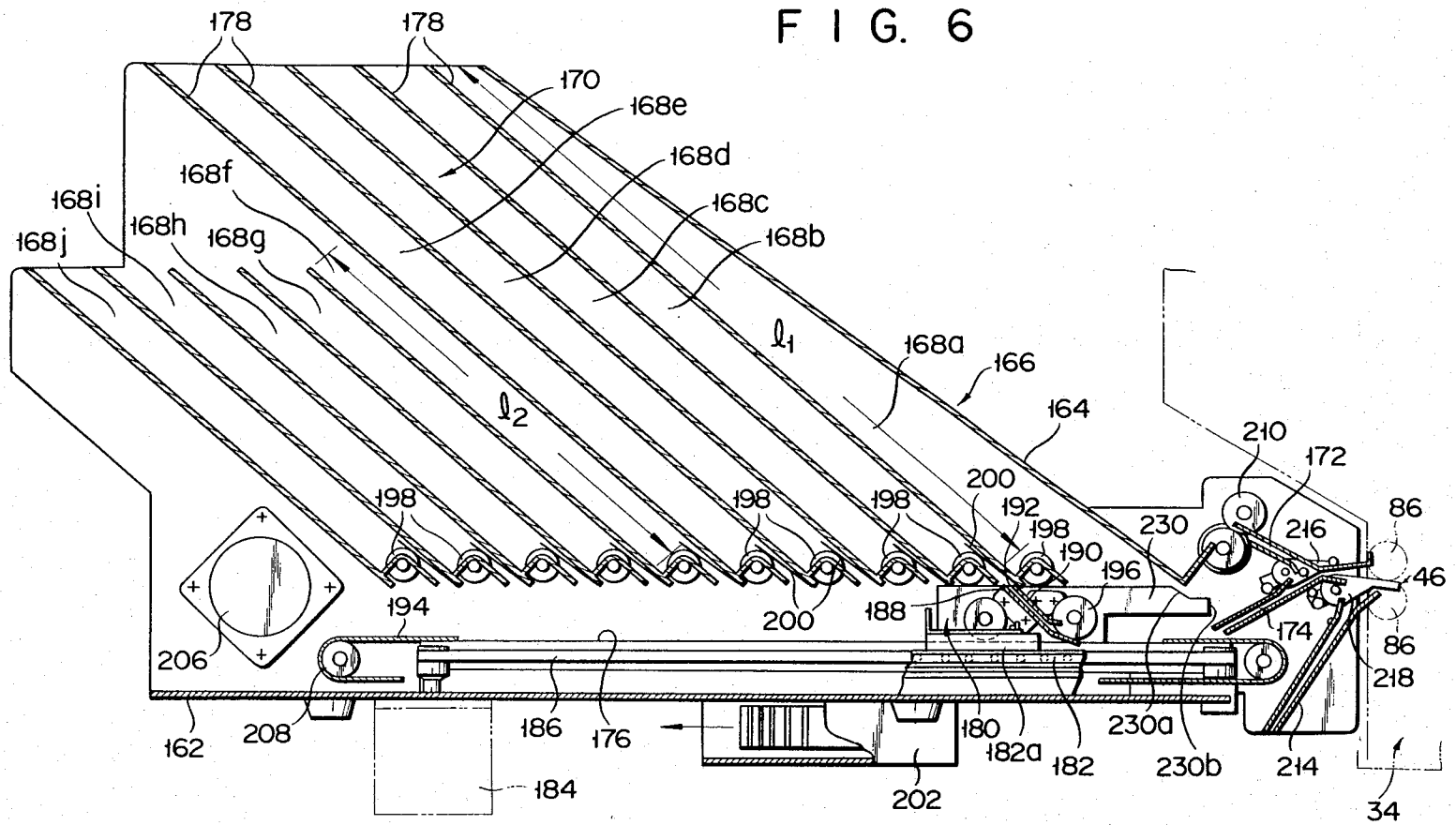
FIG. 6 is a front view of the sorter shown in FIG. 5.

The sorter 40 will now be described in detail with reference to FIGS. 5 to 11. FIGS. 5 and 6 show the overall sorter 40 which has a sorter main body 162. The sorter main body 162 has a non-sort storage section 166 having one non-sort bin 164 for storing non-sorted paper sheets P, and a sort storage section 170 having a plurality of sort bins 168*a*, 168*b*, . . . , 168*j* for sorting and storing the paper sheets P. The first to fifth sort bins 168*a* to 168*e* store large size paper sheets, while the remaining sort bins 168*f* to 168*j* store small size paper sheet. With this arrangement, flopping of large size paper sheets over the top of their bins may be prevented, while at the same time the sorter may be made compact in size.

At the paper sheet inlet side (right end in the figure) of the sorter main body 162 having the non-sort and sort storage sections 166 and 170, respectively, are formed a first (non-sort) paper sheet guide path 172 for guiding the copied paper sheets P' (or P'') from the paper discharge section 46 of the copying machine 36 to the non-sort storage section 166, and a second (sort) paper sheet guide path 174 for guiding the paper sheets P' (or P'') to the sort storage section 170.

A paper sheet convey path 176 is formed on the inner bottom surface of the sorter main body 162 so as to convey the paper sheet P' (or P'') guided from the second paper sheet guide path 174 from the right (first position) to the left (second position) horizontally.

The inlet ports of the bins 168*a* to 168*j* of the sort storage section 170 face the upper surface of the paper sheet convey path 176. Paper trays 178 are inclined at an angle of about 40° such that their upper ends are at the left in the figure and one non-sort bin is defined by two paper trays 178 adjacent to each other. The paper sheets P are stored in the respective sort bins 168*a* to 168*j* in an inclined state.

As has been described above, of the bins 168*a* to 168*j* of the sort storage section 170, the bins 168*a* to 168*e* of the earlier stages at the start end of the paper sheet convey path 176 are larger, and the bins 168*f* to 168*j* of the later stages at the rear end thereof are smaller. In other words, length (l1) of the paper trays 178 at the earlier stages is set to be longer than that (l2) of the paper trays 178 at the later stages: $l1>l2$. Thus, large size paper sheets P' (or P'') such as B4 size (257 mm×364 mm) are sorted into the bins 168*a* to 168*e*, while those of small size such as A4 size (210 mm×297 mm) are sorted into the bins 168*f* to 168*j*. Paper sheets P' (or P'') of a size larger than B4 size are sorted into the non-sort bin 164 of the non-sort storage section 166.

Figure 7:
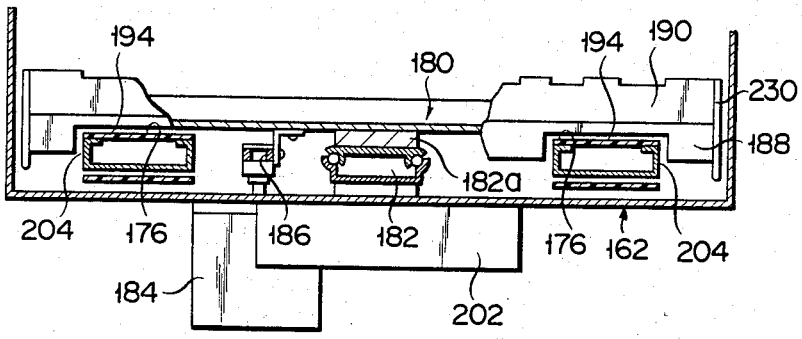
FIG. 7 is a side sectional view of the vicinity of the paper sheet convey path of the sorter shown in FIG. 6.

A bin selecting carriage 180 as selecting means for selectively supplying the paper sheets P' (or P'') conveyed on the paper sheet convey path 176 into a predetermined one of sort bins 168*a* to 168*j* is arranged thereon. As shown in FIG. 7, the bin selecting carriage 180 is mounted on a movable member 182*a* of a slide rail 182 on the upper bottom surface of the sorter main body 162, and is reciprocal along the paper sheet convey path 176. The bin selecting carriage 180 is coupled to a carriage drive belt 186 driven by a pulse motor 184 in a forward or reverse direction. The bin selecting carriage 180 has a guide path 192 which is formed to be inclined between the opposing surfaces of guide plates 188 and 190. The bin selecting carriage 180 is controlled to be driven by the movement of the carriage drive belt 186 such that the terminal end of the guide path 192 may selectively oppose one of the inlet ports of the bins 168*a* to 168*j*. The inclined lower edge of the lower guide plate 188 engages with a pair of suction conveyor belts 194 braced to form the paper sheet convey path 176. The paper sheet P' (or P'') which is sucked by the suction conveyor belts 194 and is conveyed thereby is guided into the guide path 192 after its leading end abuts against the lower guide plate 188. Feed rollers 196 are arranged in the bin selecting carriage 180 so as to contact the upper surface of the extended lower edge of the lower guide plate 188. As the feed rollers 196 rotate, the paper sheet P' (or P'') whose leading end is guided upward is forcibly fed obliquely upward against the suction force of the suction conveyor belts 194.

At the respective inlet ports of the bins 168*a* to 168*j* are arranged catch rollers 198, and guide members 200 (FIG. 6) the free ends of which lightly urge the catch rollers 198. As the catch rollers 198 rotate, the paper sheet P' (or P'') fed by the bin selecting carriage 180 is stored into one of the bins 168*a* to 168*j*.

Figure 8:
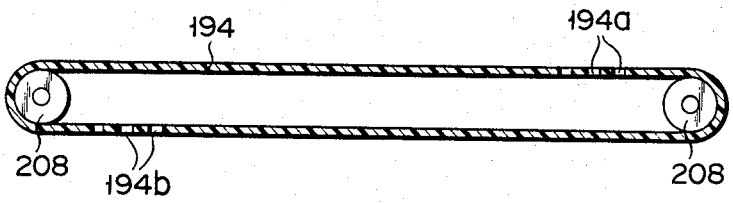
FIG. 8 is a front sectional view of the suction conveyor belt shown in FIG. 6.

On each of the suction conveyor belts 194, as shown in FIG. 8, two groups of suction holes 194*a* and 194*b*, respectively, are formed so as to allow suction of the leading end alone of the paper sheet P' (or P''). The suction conveyor belts 194 are capable of moving above the upper surfaces of a pair of negative pressure chambers 204 communicating with a fan unit 202 mounted on the lower surface of the sorter main body 162. When each group of suction holes 194*a* or 194*b* passes over the upper surfaces of the negative pressure chambers 204, suction force is generated on the upper surfaces of the belts 194.

Reference numeral 206 denotes a motor, which drives a pair of pulleys 208 on which the suction conveyor belts 194 are braced, the catch rollers 198 arranged at the inlet ports of the bins 168*a* to 168*j*, a pair of feed rollers 210 which are arranged at the terminal end of the non-sort paper sheet guide path 172 for guiding the paper sheet P' (or P'') to the non-sort storage section 166, and the feed rollers 196 of the bin selecting carriage 180. As shown in FIG. 6, the bin selecting carriage 180 has guide rollers 212.

A third (double-side copying) paper sheet guide path 214 is formed in the vicinity of the second paper sheet guide path 174 of the sorter main body 162 so as to guide to the double-side image forming feed/convey unit 49 the paper sheet P' on one surface of which an image is copied, and which is discharged from the paper discharge section 46.

Figure 10:
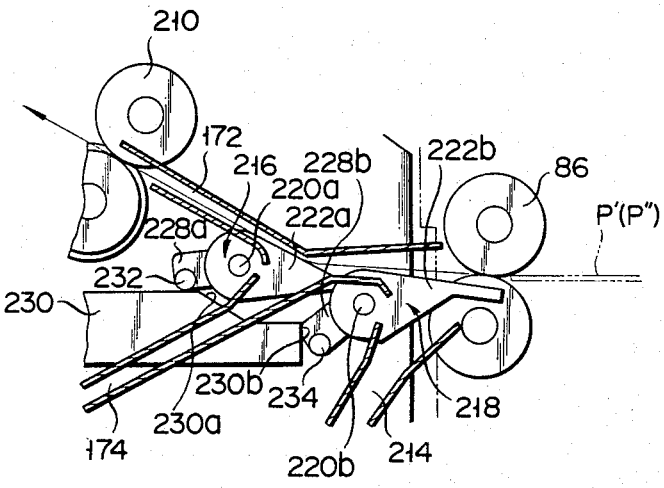
FIG. 10 is a front sectional view showing the paper sheet inlet port of the bin shown in FIG. 9 in a state in which the bin selecting carriage is in the first operating position.
Figure 9:
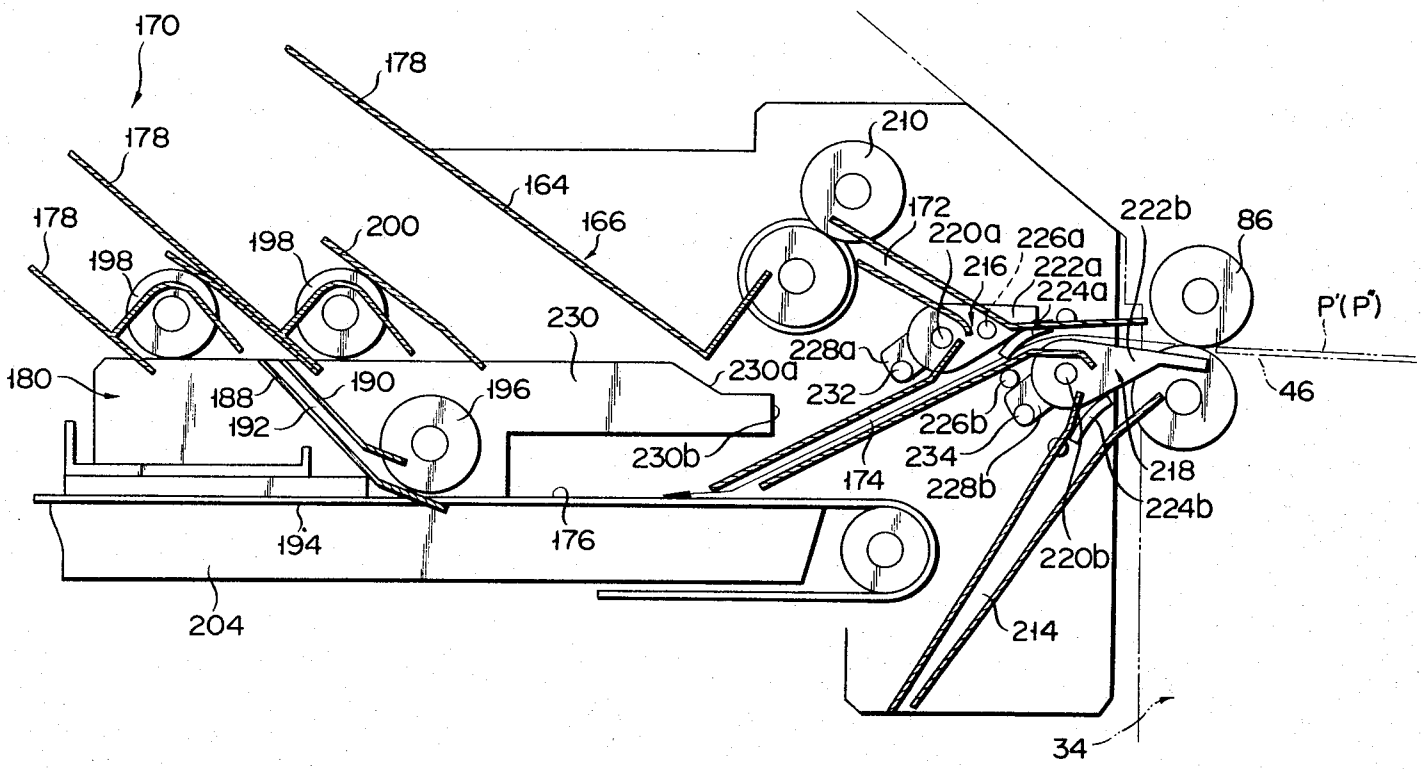
FIG. 9 is a front sectional view showing the paper sheet inlet port of a bin.
Figure 11:
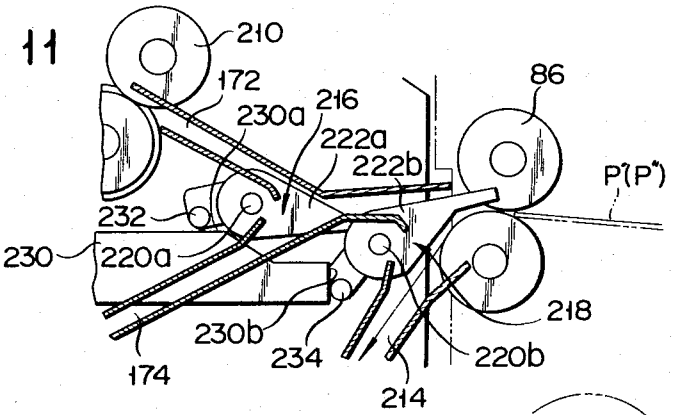
FIG. 11 is a front sectional view showing the paper sheet inlet port of the bin shown in FIG. 9 in a state in which the bin selecting carriage is in the second operating position.

As shown in detail in FIGS. 9 to 11, a second guide selector 216 as a convey direction switching means is arranged at the branch of the first paper sheet guide path 172 and the second paper sheet guide path 174. A first guide selector 218 as another convey direction switching means is arranged at the branch of the common guide path portion of the first and second paper sheet guide paths and the third paper sheet guide path 214. The guide selectors 216 and 218 respectively have gates 222*a* and 222*b* which are mounted on pivotal support pins 220*a* and 220*b*, respectively, and arms 228*a* and 228*b* which are constantly biased by springs 224*a* and 224*b* respectively to abut against stoppers 226*a* and 226*b*, respectively. Normally, as shown in FIG. 9, the first guide selector 218 closes the third guide paper guide path 214, and opens the common guide portion of the first and second paper sheet guide paths 172 and 174. The second guide selector 216 closes the first paper sheet guide path 172 and opens the second paper sheet guide path 174. As indicated by the solid arrow, the paper sheet P' (or P'') discharged from the paper discharge section 46 is generally guided to the sort storage section 170 of the sorter 40.

A cam 230 is provided in the bin selecting carriage 180 and extends to the proximal end of the paper sheet convey path 176. As shown in FIG. 10, the cam 230 has a first operating portion 230*a* which contacts a roller 232 mounted on the free end of the arm 228*a* of the second guide selector 216 when the bin selecting carriage 180 is moved to a first operating position near the paper discharge section 46. The first operating portion 230*a* comprises an inclined surface so that the roller 232 may be urged upward and the gate 222*b* may be pivoted clockwise about the support pin 220*b* when the first operating portion 230*a* contacts the roller 232. As shown in FIG. 11, the cam 230 has a second operating portion 230*b* which contacts a roller 234 mounted on the free end of the arm 228*b* of the first guide selector 218 when the bin selecting carriage 180 is moved to a second operating position (further to the right than the first operating position). The second operating portion 230*b* comprises an upright surface so that the roller 234 may be withdrawn and the gate 222*b* may be pivoted counterclockwise about the support pin 220*a*.

When a paper sheet P' (or P'') discharged from the paper discharge section 46 of the main body 36 is to be stored in the non-sort bin 164 of the non-sort storage section 166, the bin selecting carriage 180 is moved to the first operating position. Then, the second and third paper sheet guide paths 174 and 214 are closed, while the first paper sheet guide path 172 is opened. Then, the paper sheet P' (or P'') is guided as indicated by the arrow in FIG. 10. When a paper sheet P', on one surface of which an image has been copied, is to be fed to the double-side image forming feed/convey unit 49 for double-side image forming, the bin selecting carriage 180 is moved to the second position. Then, the first and second paper sheet guide paths 172 and 174 are closed, and the third paper sheet guide path 214 is opened. Then, the paper sheet P' is guided as indicated by the arrow in FIG. 11. When the bin selecting carriage 180 returns to the position where the paper sheet P' (or P'') may be stored into one of the bin 168*a* to 168*j* of the sort storage section 170, the cam 230 is separated from the rollers 232 and 234 as shown in FIG. 9. Then, by the restoring force of the corresponding springs 224*a* and 224*b*, the gates 222*a* and 222*b* return to their original positions, so that the paper sheet P' (or P'') discharged from the paper discharge section 46 is guided to the second paper sheet guide path 174.

Figure 13:
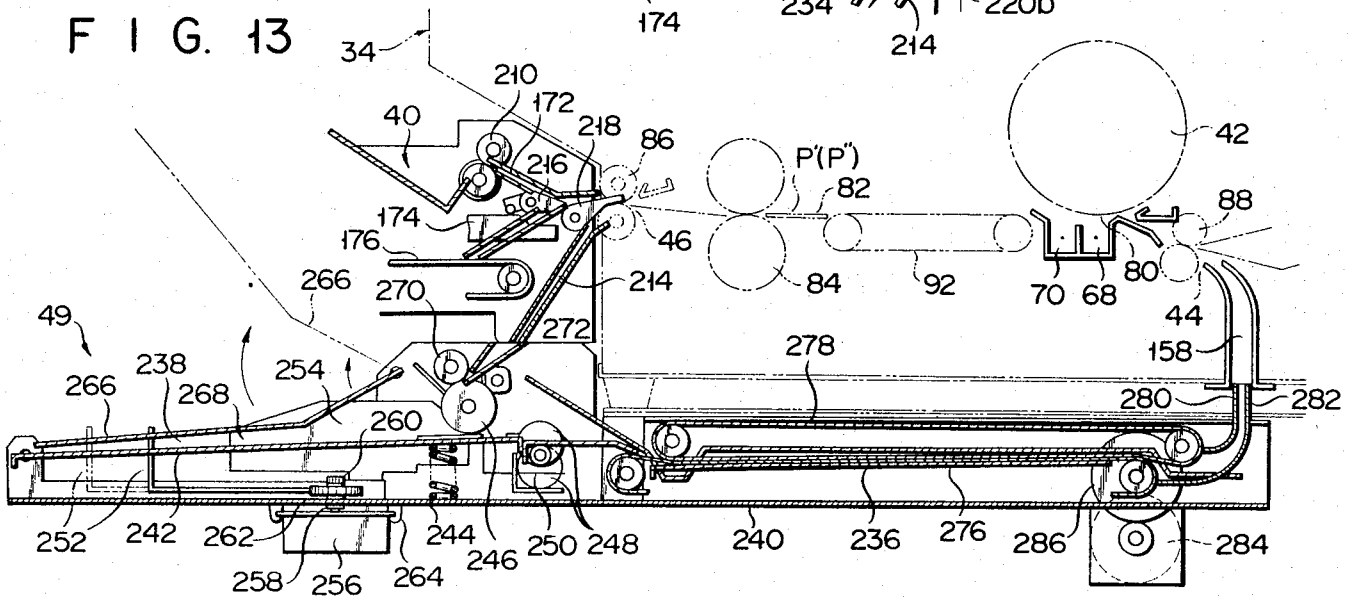
FIG. 13 is a front sectional view of the feed/convey unit shown in FIG. 12 when it is assembled in a copying machine.
Figure 12:
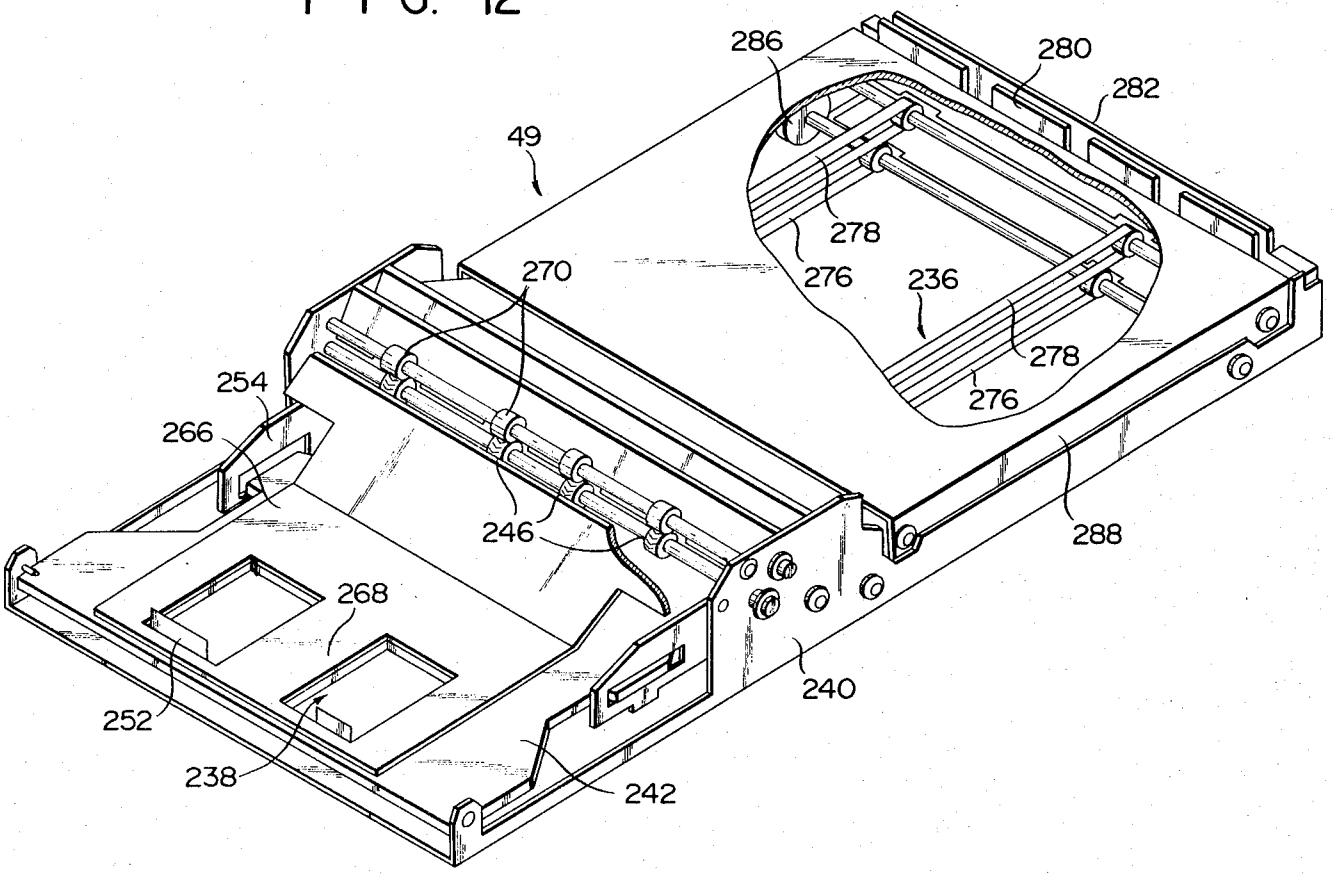
FIG. 12 is a perspective view of a double-side copying feed/convey unit for forming images on both surfaces of a paper sheet.

The double-side image forming feed/convey unit 49 (to be referred to as a unit 49) will now be described in detail with reference to FIGS. 12 to 17. FIGS. 12 and 13 show the overall unit 49. The unit 49 is arranged at the side of the lower surface of the main body 36 of the copying machine 34, that is, at the ceiling portion of the base 38. The left end of the unit 49 extends from the left side surface of the base 38 to a position below the lower surface of the sorter 40.

The unit 49 includes a unit main body 240. The unit main body 240 has a refeed/convey path 236 which refeeds to the image transfer section 80 of the copying machine 34 the paper sheet P' fed through the third paper sheet guide path 214 of the sorter 40, and also has a stacker portion (turning one copied surface backside up portion) 238 provided in the refeed/convey path 238. The stacker portion 238 is arranged at the start end of the refeed/convey path 236, that is, at the left-hand side of the unit 49. The stacker portion 238 temporarily stores the paper sheets P', on one surface of each of which an image is copied, and feeds them to the refeed/convey path 236 after turning their copied surfaces backside up to allow double-side image forming.

The stacker portion 238 has the configuration described below. A paper tray 242, the left end of which is pivotally supported, is substantially supported on the upper left surface of the unit main body 240. The free end (right-hand side) of the paper tray 242 is constantly biased upward by a spring 244. By the biasing force of the spring 244, the upper surface of the free end of the paper tray 242 is in contact with catch/feed rollers 246 of the paper tray 242. A lever 250 in contact with eccentric cam rollers 248 is mounted integrally with the free end of the paper tray 242. As the eccentric cam rollers 248 rotate, the paper tray 242 can be brought into contact with or separated from the catch/feed rollers 246.

Figure 14:
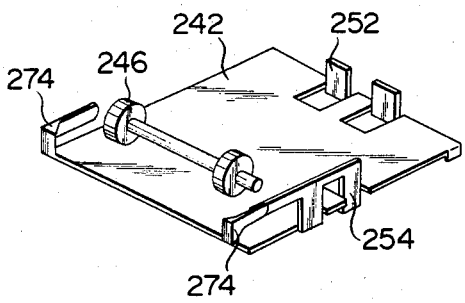
FIG. 14 is a perspective view of a paper tray shown in FIG. 12.
Figure 15:
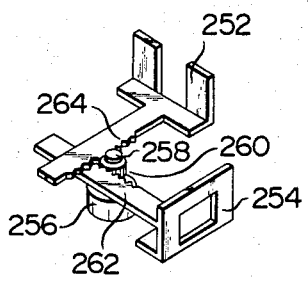
FIG. 15 is a perspective view of the aligning plates shown in FIG. 14.

As shown in detail in FIG. 14, first and second aligning plates 252 and 254 are fitted in at two adjacent sides of the paper tray 242. Referring to FIG. 15, the first and second aligning plates 252 and 254 have formed integrally therewith first and second racks 262 and 264 which mesh with first and second pinions 258 and 260 driven by a drive source 256 such as a pulse motor. Thus, the first and second aligning plates 252 and 254 are capable of simultaneous reciprocal movement.

A guide cover 266 is arranged on the upper surface of the paper tray 242. The guide cover 266, together with the paper tray 242, defines a temporary stack chamber 268. The guide cover 266 serves to guide the paper sheet P' fed through the catch/feed rollers 246 and feed rollers 270 rolling immediately thereabove onto the paper tray 242 to be stacked thereon. The guide cover 246 is pivoted to open the upper side of the temporary stack chamber 268 as needed.

The unit main body 240 is provided with a paper sheet guide path 272 which guides a paper sheet P' fed from the third paper sheet guide path 214 of the sorter 40 to a position between the catch/feed rollers 246 and the feed rollers 270. Separation pawls 274 are arranged in the vicinity of the catch/feed rollers 246 so as to press the corners of the paper sheet P' at its leading end.

Figure 16A:
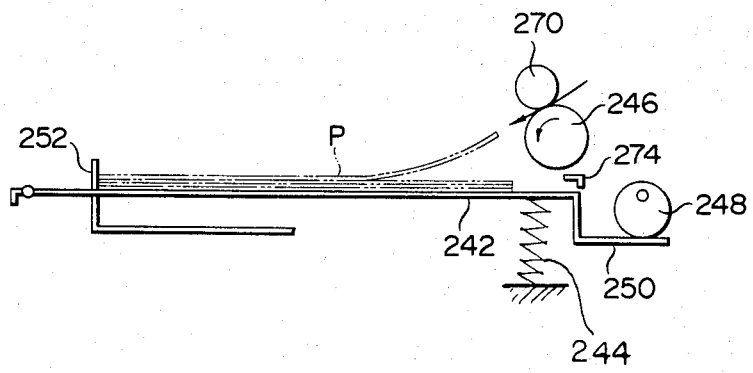
FIGS. 16A to 16C are schematic front views showing the operation for guiding a paper sheet, on one surface of which an image is formed, to the transfer unit.
Figure 16B:
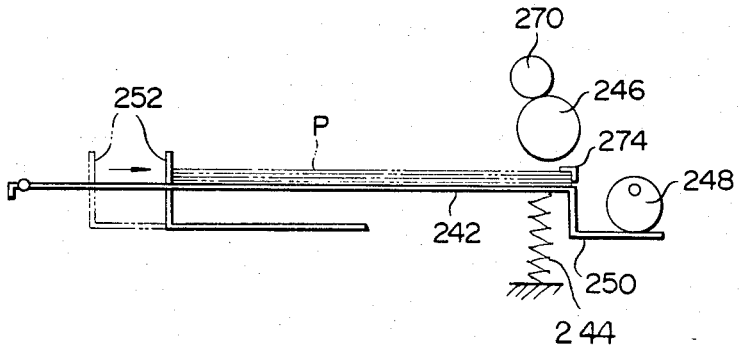

As shown in FIG. 16A, when the paper sheet P' is to be received, the paper tray 242 is pressed downward by the eccentric cam rollers 248 to be separated from the catch/feed rollers 246. The paper tray 242 is arranged to be substantially horizontal, and the first and second aligning plates 252 and 254 are positioned at the outer positions thereof. In this case, the paper sheets P' fed into the temporary stack chamber 268 through the catch/feed rollers 246 and the feed rollers 270 are stacked on the paper tray 242. When the paper sheets P' are stacked in this manner, the first and second aligning plates 252 and 254 are moved to their innermost positions to oppose the corners of the paper sheets P' at its leading end to the separation pawls 274, as shown in FIG. 16B. The eccentric cam rollers 248 rotate half a revolution, and the paper tray 242 is urged upward by the springs 244. Then, the paper sheets P' stacked on the paper tray 242 are urged against the catch/feed rollers 246, and the corners of the uppermost paper P' at its leading end are pressed by the separation pawls 274.

Subsequently, the catch/feed rollers 246 are rotated in the opposite direction so as to sequentially feed the paper sheets P' from the uppermost one from their trailing ends (during feeding) into the refeed/convey path 236.

That portion of the refeed convey path 236 having the stacker portion 238 of the above configuration as described above at its intermediate portion, which opposes the lower surface of the copying machine 34, includes a space defined between the opposing surfaces of a pair of parallel lower conveyor belts 276 and a pair of upper conveyor belts 278, and of the space defined between the opposing surfaces at one end of each of a pair of guide plates 280 and 282. The other end of each of the guide plates 280 and 282 projects above the upper surface of the base 38 so as to guide the paper sheet P' into the third paper sheet guide path 158 formed in the paper feed section 44 of the copying machine 34.

Referring to FIG. 13, the upper and lower conveyor belts 276 and 278 are powered by a motor 284 mounted on the lower surface of the unit main body 240 through a power transmission mechanism 286. The upper conveyor belts 278 are braced on upper members 288 which are detachably mounted on the unit main body 240.

Figure 17:
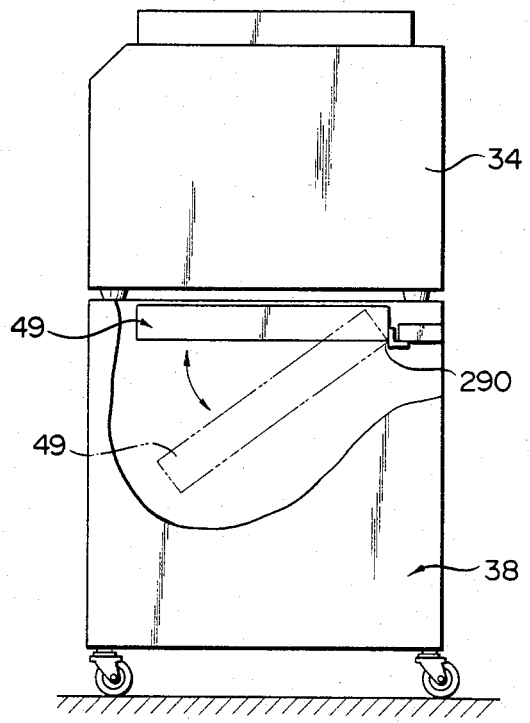
FIG. 17 is a schematic front view showing the mounted state of the feed/convey unit.

The rear end of the double-side image forming refeed/convey unit 49 of the configuration as described above is pivotally mounted through a hinge mechanism 290 and is movable as indicated by the broken line to open the refeed/convey path 236, as shown in FIG. 17. The free end (front end) of the unit 49 is fixed by a locking mechanism (not shown), and the locking operation of the locking mechanism may be released as needed.

The mode of operation of the image forming apparatus as described above will now be described mainly with reference to FIG. 2.

Storage of the paper sheet P'' into the non-sort bin 164 of the sorter 40 will first be described. The operator depresses the copy start button after depressing the double-side copying button, the sort selection button, the paper size selection button, the copy number selection button, and so on. Then, a toner image corresponding to the image on the document is formed on the surface of the photosensitive drum 42. The toner image is transferred onto a paper sheet P which is picked up and fed from either the paper cassette 98 or the feeder 100. The paper sheet P' on one surface of which an image is formed is supplied to the fixing rollers 84 for fixing the image, and is then discharged by the paper discharge rollers 86.

In this state, the bin selecting carriage 180 of the sorter 40 is in the second position near the paper discharge section 46 of the copying machine 34 such that the first guide selector 218 is switched to open the third paper sheet guide path 214 (the state shown in FIG. 11). Thus, the paper sheet P' is fed into the temporary stack chamber 268 of the stacker portion 238 of the unit 49 (the state shown in FIG. 16A).

Figure 16C:
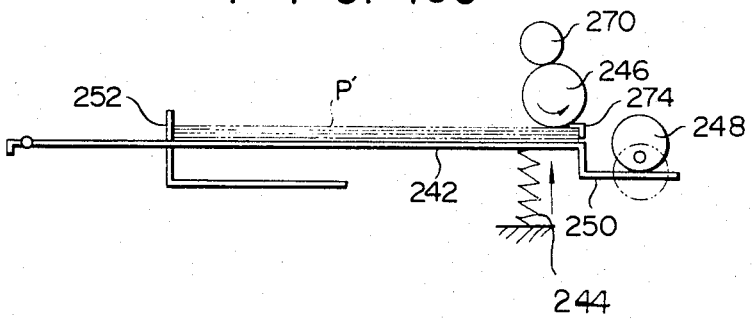

When the selected number of paper sheets P' are stacked on the temporary stack chamber 268, the paper sheets P' are aligned and are sequentially fed out after being turned upside down (the state shown in FIGS. 16B and 16C).

The paper sheets P' are sequentially supplied again to the image transfer unit 80 through the refeed/convey path 236, the paper feed section 44 and the third paper sheet guide path 158. The flow of the paper sheets P and P' is indicated by thick solid lines in FIG. 2.

When the paper sheets P' are supplied to the image transfer unit 80, toner images are formed on those surfaces on which no image has yet been formed. The paper sheets P'' thus obtained are conveyed to the paper discharge section 46. After fixing the images, the paper sheets P'' are discharged by the paper discharge rollers 86. In response to a release signal of the sort selection button, the bin selecting carriage 180 is moved to the first position in advance to switch the first and second guide selectors 218 and 216 into the non-sort bin 164 of the non-sort storage section 166 of the sorter 40 (the state shown in FIG. 10).

The paper sheets P'' are stored in the non-sort bin 164 through the first paper sheet guide path 172. The flow of the paper sheets P'' is indicated by arrows indicated by broken line in FIG. 2.

When the paper sheets P'' are to be selectively stored in the sort bins 168*a* to 168*j* of the sort storage section 170 of the sorter 40, the sort selection button must be depressed by the operator to command the sorting operation.

If the sorting operation is executed in this manner, when the paper sheets P' are sequentially fed from the stacker portion 238, the bin selecting carriage 180 is withdrawn to oppose the sort storage section 170. Subsequently, the first and second guide selectors 218 and 216 may be switched so as to guide the paper sheets P'' into the paper sheet convey path 176 corresponding to the sort storage section 170 (FIG. 9).

In this manner, the paper sheets P'' are guided to the paper sheet convey path 176 through the second paper sheet guide path 174. At the same time, the bin selecting carriage 180 moves to a predetermined position so that the paper sheets P'' are stored into the bins 168*a* to 168*j* of the sort storage section 170. The flow of the paper sheets P'' is indicated by arrows along by the one dot and dash line.

When double-side image forming is not required, the instruction entered by the double-side forming button is released. Then, the paper sheets P' are not fed to the unit 49 but are selectively fed to the first and second paper sheet guide paths 172 and 174 in accordance with the sort or non-sort instruction. In the manner as described above, the paper sheets P' are stored in the non-sort bin 164 or the sort bins 168*a* to 168*j*.

According to this embodiment of the present invention, the paper sheets P' (or P'') to be stored in the sort bins 168*a* to 168*j* of the sort storage section 170 are conveyed in a substantially horizontal attitude along the paper sheet convey path 176. Thereafter, the paper sheets P' (or P'') are fed obliquely upward by the bin selecting carriage 180 which can be moved and stopped along the paper sheet convey path 176, and are stored in the corresponding bins. In a conventional copying machine, the paper sheets are generally conveyed first horizontally and then vertically so as to selectively actuate the pawls which respectively oppose the bins. In comparison with such a conventional copying machine, the convey system of the image forming apparatus of the present invention can be simplified. Furthermore, the paper sheets P' (or P'') may be smoothly changed in direction so as to prevent jamming at the inlet ports of the bins 168*a* to 168*j*.

The inlet ports of the bins 168*a* to 168*j* oppose the upper surface of the paper sheet convey path 176 which conveys the paper sheets from the first position to the second position in a substantially horizontal attitude. A plurality of paper trays 178 are inclined such that the leading edges of the paper sheets P' (or P'') are inclined upward. Since the paper sheets P' (or P'') fed to the bins 168*a* to 168*j* are stored in an inclined posture, the lower ends are registered irrespective of their sizes.

Furthermore, in accordance with the image forming apparatus of the present invention, the bins 168*a* to 168*e* toward the start end of the paper convey path 176 are larger to store the paper sheets P' (or P'') of larger size, while the bins 168*f* to 168*j* toward the rear end are smaller to store the paper sheets P' (or P'') of smaller size. For this reason, the overall sorter 40 may be made compact in size.

The non-sort bin 166 for storing non-sorted paper sheets P' (or P'') is arranged at a stage prior to the sort storage section 170 for storing the paper sheets P' (or P''). Therefore, jamming which may otherwise be caused during the sorting operation of the paper sheets P' (or P'') may be reduced to the minimum.

In accordance with the image forming apparatus of the embodiment described above, the selection by the second guide selector 216 of the conveying direction of the paper sheets P' (or P'') which need not be sorted is performed by the bin selecting carriage 180 at a position close to the paper discharge section 46. Therefore, switching of the sorting/non-sorting operation is easy.

In summary, according to the present invention, a bin selecting carriage is movably arranged along a paper sheet convey path which communicates with a sort paper sheet convey path. The paper sheet fed to the paper sheet convey path by the bin selecting carriage is fed to one of the sort bins. As the bin selecting carriage moves, a guide selector which is arranged at the branch between the non-sort paper sheet convey path and the sort paper sheet convey path is operated. A drive means for driving the guide selector for selectively feeding the paper sheets discharged from the paper discharge section to the sort and non-sort paper sheet guide paths is not required. The operation timing of the guide selector may be synchronized with the feed operation timing of the paper sheets into the respective bins of the sort storage section. The present invention thus allows reliable sorting at low cost.

The present invention is not limited to the particular embodiment described above. Various other changes and modifications may be made within the spirit and scope of the present invention.

Figure 18:
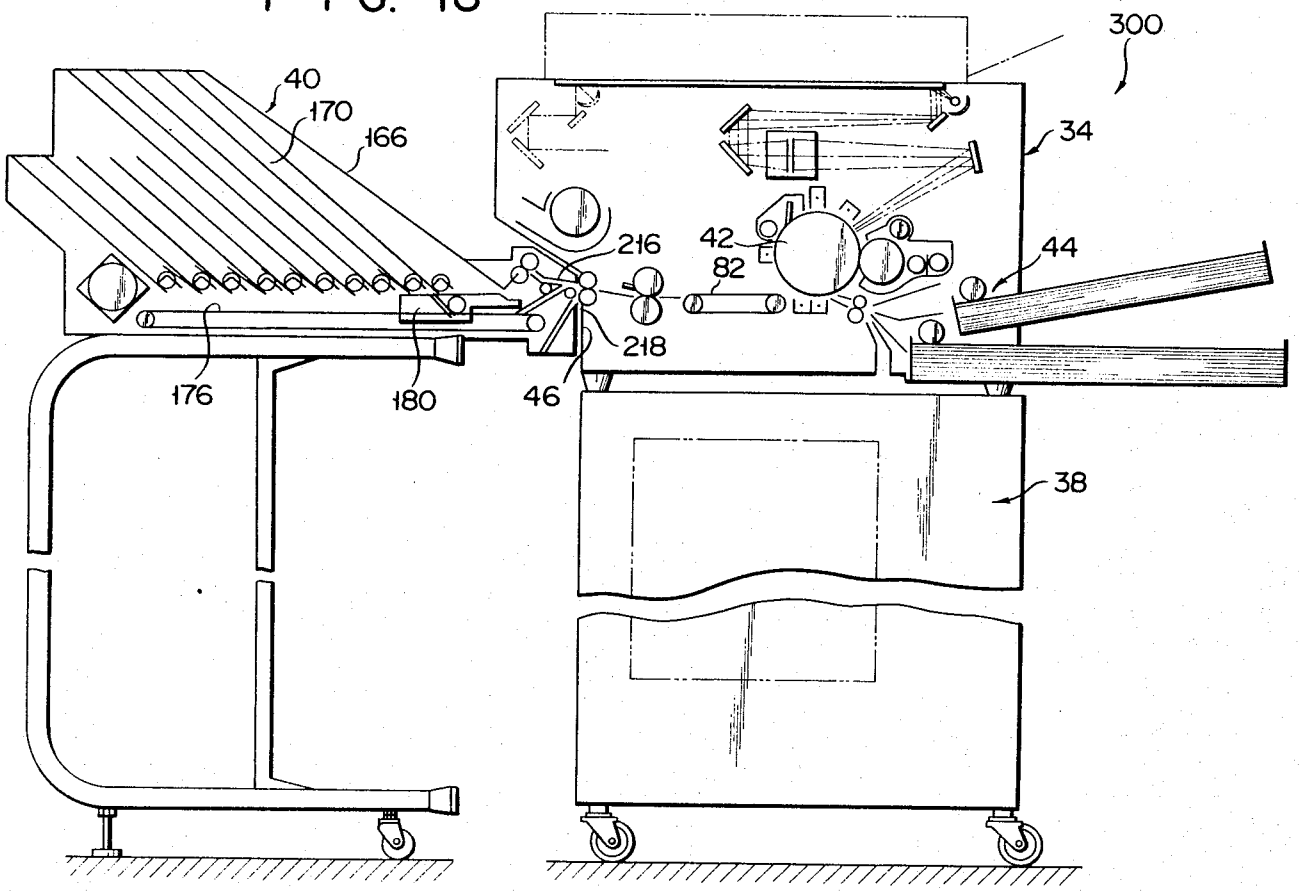
FIG. 18 is a schematic front view showing the other embodiment of an electronic copying apparatus according to the present invention.

The embodiment is described with reference to a case wherein the double-side image recording feed/convey unit 49 is mounted on a double-side copying machine. However, the present invention is not limited to this construction. For example, as shown in FIG. 18, the unit 49 may be mounted on a single-side copying machine 300.

In the above description, the same reference numerals denote the same parts throughout.

What is claimed is:

1. An image forming apparatus of the type including a housing, an image carrier housed within said housing, image forming means for forming an image on said image carrier paper feeding means, arranged at one side of said housing, for feeding a paper sheet into said housing, paper discharging means, arranged at the other side of said housing, for discharging the paper sheet from the housing to the outside, first paper sheet conveying means for conveying the paper sheet fed from said paper feeding means to said paper discharging means along a conveying path through said image forming means, transferring means for transferring the image formed on said image carrier onto one surface of the paper sheet conveyed by said first paper sheet conveying means, and sorter means detachably mounted on the other side of said housing for sorting the paper sheets discharged from said paper discharging means, wherein said sorter means comprises:

(a) a plurality of paper sheet storage chambers which are aligned in a predetermined substantially horizontal direction outward from the other side of said housing and which define openings at lower ends thereof;

(b) second paper sheet conveying means for conveying the paper sheets discharged from said paper discharging means in said predetermined direction along a sort conveyance path below said paper sheet storage chambers;

(c) another paper sheet storage chamber for storing paper sheets other than said sorted paper sheets discharged from said paper discharging means, said another paper sheet storage chamber defining an opening adjacent in said predetermined direction to an opening of one of said paper sheet storage chambers which is closest to the other side of said housinq;

(d) a common guide path, one end of which opposes said paper discharging means;

(e) a first guide path, one end of which opposes the other end of said common guide path and the other end of which communicates with said another paper sheet storage chamber;

(f) a second guide path, one end of which opposes the other end of said common guide path and the other end of which opposes a proximal end of said second paper sheet conveying means ;

(g) conveying direction switching means, arranged at the other end of said common guide path and movable into first and second positions, said conveying direction switching means for selectively conveying the paper sheet discharged from said paper discharging means and guided by said common guide path to one of said first and second guide paths when moved into one of said first and second positions, respectively;

(h) selecting means movable in said predetermined direction between one of a plurality of sort positions wherein said selecting means is in opposing relationship to a predetermined one of said openings of said paper sheet storage chambers and a first operating position wherein said selecting means is in opposing relationship to said opening of said another paper sheet storage chamber, said selecting means for selectively supplying the paper sheets conveyed by said second paper sheet conveying means into a predetermined one of said paper sheet storage chambers when moved into said one of said sort positions and for supplying paper sheets discharged by said discharging means into said opening of said another paper sheet storage chamber when moved into said first operating position; and (i) displacing means for displacing said selecting means in said predetermined direction between said one of said sort positions and said first operating position to responsively cause said selecting means to respectively selectively oppose said opening of said predetermined one of said paper sheet storage chambers or said opening of said another paper sheet storage chamber, wherein said selecting means for (1) moving said conveying direction switching means into said first position thereby establishing communication between said common guide path and said first guide path in response to said displacing means displacing said selecting means into said first operating position to guide the paper sheet discharged from said discharging means into said another paper sheet storage chamber, and (2) moving said conveying direction switching means into said second position thereby establishing communication between said common guide path and said second guide path in response to said displacing means displacing said selecting means into said one of said sort positions to guide the paper sheet conveyed by said second conveying means into said predetermined one of said paper sheet storage chambers.

2. An apparatus according to claim 1 wherein said conveying direction switching means includes:

a gate which is movable between said first position to close said first guide path and open said second guide path, and said second position to open said first guide path and close said second guide path, and biasing means for biasing said gate to said first position thereof.

3. An apparatus according to claim 2, wherein said selecting means includes a cam which is adapted to be brought into contact with said gate, said cam having a cam surface to move said gate to said second position thereof against a biasing force of said biasing means when said selecting means is in said first operating position.

4. An apparatus according to claim 1, which further comprises double-side image forming conveying means, removably mounted below said housing, for returning the paper sheet discharged from said paper discharging means in an inverted state to a proximal end of said conveying path.

5. An apparatus according to claim 4, wherein said conveying direction switching means includes:

a gate which is movable between said first position to close said first guide path and open said second guide path, and said second position to open said first guide path and close said second guide path; and biasing means for biasing said gate to said first position thereof.

6. An apparatus according to claim 5, wherein said selecting means includes a cam which is adapted to be brought into contact with said gate, said cam having a cam surface to move said gate to the second position therof against a biasing fore of said biasing means when said selecting means is in said first operating position.

7. An apparatus according to claim 6, wherein said sorter means includes:

a third guide path, one end of which opposes said paper discharging means in alignment with said common guide path; and second conveying direction switching means, arranged between said common guide path and said third guide path, said second conveying direction switching means having third and fourth positions for selectively conveying the paper sheet discharged from said paper discharging means to one of said common guide path and said third guide path when in said third and fourth positions, respectively.

8. An apparatus according to claim 7, wherein said second conveying direction switching means includes:

a second gate which is movable between said third position to open said common guide path and close said third guide path, and said fourth position to close said common guide path and open said third guide path; and second biasing means for biasing said second gate to the third position thereof.

9. An apparatus according to claim 8, wherein said selecting means is movable to a second operating position, upstream of said first operating position, and wherein said cam includes a second cam surface to move said second gate to said fourth position thereof against a biasing force of said second biasing means in response to said selecting means being moved into said second operating position.

10. An image forming apparatus of the type including means defining a copy path having feed and discharge ends, feed and conveying means for sequentially feeding paper sheets into said copy path at said feed end and for sequentially conveying said paper sheets along said copy path, discharge means for discharging said paper sheets from said copy path at said discharge end, image transfer means disposed between said feed and discharge ends of said copy path for transferring an image of a master document onto one side of at least one of said paper sheets as said one paper sheet is conveyed along said copy path, and sorter means operatively connected to said discharge means for sorting said paper sheets, the improvement wherein said sorter means comprises:

at least one sort storage chamber and a nonsort storage chamber;

means defining (a) a first guide path in communication with said nonsort storage chamber, (b) a second guide path in communication with said sort storage chamber, and (c) a common guide path in communication with said discharge end of said copy path and said first and second guide paths;

conveying direction switching means operatively associated with said common guide path and moveable between (i) a first switching position wherein communication is established between said common and said first guide paths so that a paper sheet discharged by said discharge means is guided into said nonsort storage chamber, and (ii) a second switching position wherein communication is established between said common and said second guide paths so that a paper sheet discharged by said discharge means is guided into said at least one sort storage chamber;

selecting means displaceable between sort and nonsort positions for selectively moving said conveying direction switching means between said first and second switching positions, respectively, said selecting means including cam means defining a cam surface engageable with said conveying direction switching means when said selecting means is displaced into said nonsort position to responsively translate displacement of said selecting means into movement of said conveying direction switching means from said second switching position to said first switching position whereby communication between said common and first guide paths is established; and displacing means for displacing said selecting means between said sort and nonsort positions to respectively cause disengagement and engagement between said cam surface of said selecting means and said conveying direction switching means.

11. An image forming apparatus as in claim 10 wherein said conveying direction switching means includes:

gate means mounted for pivotal movement between said first and second switching positions; and biasing means for biasing said gate means into said second position, wherein said cam surface of said selecting means translates displacement of said selecting means from said sort position to said nonsort position into pivotal movement of said gate means from said first switching position to said second switching position.

12. An image forming apparatus as in claim 11 further comprising double-side image forming conveying means, including a double-side image forming conveying means, including a double-side storage chamber, for returning paper sheets discharged by said discharge means in an inverted state to said transfer means whereby an image of a master document is transferred to another side of said paper sheet.

13. Image forming apparatus as in claim 12 wherein said sorter means further comprises means defining a third guide path in communication with said discharge means and said double-side storage chamber.

14. Image forming apparatus as in claim 13 wherein said conveying direction switching means includes second gate means pivotally moveable between (a) a third switching position wherein communication is established between said common guide path and said discharge means so that a paper sheet discharged by said discharge means is guided into said common guide path, and (b) a fourth switching position wherein communication is established between said discharge means and said third guide path so that a paper sheet discharged by said discharge means is guided into said double-side storage chamber.

15. Image forming apparatus as in claim 14 wherein said selecting means is displaceable into a second nonsort position, upstream of said first-mentioned nonsort position, and wherein said cam means defines a second cam surface engageable with said second cam means to responsively translate displacement of said selecting means from said first-mentioned nonsort position to said second nonsort position into pivotal movement of said gate means from said fourth position to said third position; and wherein said displacing means displaces said selecting means between said first-mentioned and said second nonsort positions to cause disengagement and engagement, respectively, between said second cam surface and said second gate means.

16. Image forming apparatus as in claim 15 wherein said first-mentioned cam surface and said second cam surface are disposed relative to one another such that said first-mentioned cam surface maintains said first-mentioned gate means in said first switching position when said selecting means is moved into said second nonsort position.

17. Image forming apparatus as in claim 10 further comprising plural sequentially disposed sort chambers.

18. Image forming apparatus as in claim 17 wherein said selecting means is displaceable between plural sort positions each corresponding to a respective one of said plural sort chambers.

19. Image forming apparatus as in claim 18 wherein said selecting means includes means defining a sort guide path displaceable with said selecting means between said plural sort positions so as to establish communication between said second guide path and said respective one of said plural sort chambers.

20. Image forming apparatus as in claim 19 wherein said sorter means further comprises second conveying means for conveying paper sheets along said second path.

21. Image forming apparatus in claim 10 wherein said sorter means further comprises second conveying means for conveying paper sheets along said sort conveyance path.

* * * * *